United States Patent [19]

Strauss

[11] Patent Number: 4,656,388

[45] Date of Patent: Apr. 7, 1987

[54] TENSED MASK COLOR CATHODE RAY TUBE AND MASK SUPPORT FRAME THEREFORE

[75] Inventor: Paul Strauss, Chicago, Ill.

[73] Assignee: Zenith Electronics Corporation, Glenview, Ill.

[21] Appl. No.: 735,887

[22] Filed: May 17, 1985

[51] Int. Cl.[4] ..... H01J 29/81

[52] U.S. Cl. ..... 313/402; 313/477 R; 220/2.1 A

[58] Field of Search ..... 313/402, 407, 477 R; 220/2.1 A, 2.3 A, 2.1 R

[56] References Cited

U.S. PATENT DOCUMENTS

| | | | |
|---|---|---|---|
| 2,761,990 | 9/1956 | Amdursky et al. | 313/417 |
| 3,166,211 | 1/1965 | Stel et al. | 220/2.1 A |
| 3,404,302 | 10/1968 | Nicklas | 313/402 |
| 3,440,469 | 4/1969 | Bradu et al. | 313/482 |
| 3,638,063 | 1/1972 | Tachikawa et al. | 313/348 |
| 3,720,345 | 3/1973 | Logue | 220/2.1 A |
| 3,873,874 | 3/1975 | Shinal | 313/402 |
| 3,894,321 | 7/1975 | Moore | 445/30 |
| 4,037,255 | 7/1977 | Hill | 220/2.1 A |
| 4,069,567 | 1/1978 | Schwartz | 445/30 |
| 4,169,274 | 9/1979 | Larson et al. | 220/2.1 A |
| 4,432,464 | 2/1984 | Seats et al. | 220/2.1 A |
| 4,461,971 | 7/1984 | Puhak | 313/402 |
| 4,495,437 | 1/1985 | Kume et al. | 313/407 |

FOREIGN PATENT DOCUMENTS

| | | | |
|---|---|---|---|
| 558694 | 6/1958 | Canada | 220/2.3 A |
| 2122948 | 12/1971 | Fed. Rep. of Germany | 313/477 R |
| 1026624 | 4/1966 | United Kingdom | 220/2.1 A |
| 1163495 | 9/1969 | United Kingdom . | |

*Primary Examiner*—Stewart J. Levy
*Assistant Examiner*—Hezron E. Williams
*Attorney, Agent, or Firm*—Cornelius J. O'Connor

[57] ABSTRACT

A tensed mask cathode ray tube has a support frame supporting a tensed mask adjacent to a flat or cylindrical panel wholly within the tube. The support frame includes an outer flange, a shelf extending radially inwardly from the flange and providing a support surface for the tensed mask, and an elongated skirt directed rearwardly from the shelf and adapted to join to the remainder of the CRT. The support frame forms a major part of the CRT envelope and includes strengthening ribs extending from the outer flange to the elongated skirt. The support frame resists deformation by tensile forces exerted by the tensed mask and discontinuity stresses imposed by the flat panel upon tube evacuation. The Q-distance between the mask support surface and the inner surface of the flat panel is determined by the support surface being offset from the seal surface.

4 Claims, 5 Drawing Figures

TENSED MASK COLOR CATHODE RAY TUBE AND MASK SUPPORT FRAME THEREFORE

CROSS-REFERENCE TO RELATED APPLICATIONS

This application is related to but in no way dependent upon copending application Ser. Nos. 538,001 and 538,003 both filed Sept. 30, 1983; Ser. Nos. 572,088 and 572,089 both filed Jan. 18, 1984; Ser. Nos. 646,861 and 646,862, both filed Aug. 31, 1984; and Ser. No. 729,015, filed April 29, 1985; Ser. No. 725,040, filed April 19, 1985; Ser. No. 772,406, filed April 26, 1985; and Ser. No. 729,020, filed April 30, 1985 all of common ownership herewith.

BACKGROUND OF THE INVENTION AND PRIOR ART DISCLOSURES

This invention relates generally to tensed mask cathode ray tubes (CRTs) and particularly to a novel construction of such tubes.

Color CRTs, that is, those capable of displaying images in color, have been in existence for many years. The so-called shadow mask type of color CRT is most popular and is generally constructed with a target or screen consisting of a regular pattern of photo-deposited triads of red, blue and green light-emitting phosphors. The shadow mask is foraminous and is positioned a predetermined distance from the target, and by virtue of its pattern of apertures, effectively shadows all but selected ones of the individual light-emitting phosphors from its corresponding electron beam-emitting source located in the neck of the CRT. Since each CRT's shadow mask is used in photoscreening the phosphor target therein, means for enabling repeatable, precise interregistration of the shadow mask and the CRT faceplate is a necessity. In most CRTs, the shadow mask comprises a generally spherical foraminous metal sheet supported on a relatively heavy frame. The mask is capable of self-maintaining its configuration and is repeatably positioned in registration with the CRT panel by recourse to a plurality of studs embedded in the panel, and a corresponding plurality of stud-engaging flat springs attached to its supporting frame. The apparatus and screening techniques for such CRTs are all well-known in the art and will not be described further herein.

The limitations of the shadow mask with respect to power-handling capability and image resolution are well-known. This invention concerns a novel "tensed mask" CRT which utilizes a shadow mask in the form of a thin foil, with suitable apertures. The mask is held under tension in position adjacent to a flat or cylindrical phosphor-screen-bearing facepanel. Since the foil mask is extremely thin, etching of the apertures therein can be very precisely controlled, thus making a very high resolution tube an economic reality. Also, since the foil is under significant tension: that is, close to the elastic limit of the material used, it may be heated to a high temperature before the tension is relieved and mask distortion sets in. The electron energy that a tensed foil mask can absorb without significant degradation in color purity is much greater than that for a conventional spherical shadow mask. Consequently, a much brighter, sharper image is possible with a tensed mask CRT.

One of the inherent problems in a tensed mask CRT is that the support frame for the mask must be capable of withstanding the relatively large tension forces exerted by the mask thereon without substantial deformation. One mask support technique described and claimed in referent copending application Ser. No. 538,001, involves attaching the periphery of the mask to a glass support frame by means of a devitrifiable glass or "frit". The mask is typically composed of a steel that has a coefficient of thermal expansion selected to be significantly greater than that of glass. The mask is joined to the support frame under a sustained modest tension with a bead of devitrifiable frit. The assembly is heated to a temperature at which the frit devitrifies. During the heat cycle, the steel mask expands at a much greater rate than the glass support frame. When the frit devitrifies, it firmly bonds the periphery of the mask to the support frame. Upon cooling, the mask is prevented from returning to its original size and thereby is subjected to high tension forces—e.g., 30,000 psi.

As alluded to above, in accordance with conventional photographic techniques for fabricating the phosphor screens on the face panels of color CRTs, the shadow mask is used as a stencil and must therefore be repeatedly positioned in accurate registration with the panel and with respect to the light sources that stimulate the electron beams developed by the electron guns in the CRT. It will be appreciated that any deformation in the support frame for the tensed mask will result in corresponding distortions in the tensed mask aperture pattern during screening, and a corresponding distortion in the phosphor screen formed.

In accordance with referent copending applications, the tensed mask support frame ultimately becomes a structural element of the CRT envelope. During the assembly process, the entire CRT structure including panel, support frame and funnel, are subjected to an elevated temperature. When the frit devitrifies, a unified glass structure results that is hermetically sealed against the atmosphere. As the support frame and tensed mask are heated during the assembly process, the mask expands more than the frame, and the tension in the mask is greatly reduced. Deformation in the mask support frame is correspondingly reduced. As the devitrifiable frit vitrifies at the sealing temperature., the support frame is captured between the rigid panel and funnel portions of the CRT. Upon subsequent cooling, the tension forces are again exerted by the tensed mask, on the frame, but do not result in deformation of the support frame because it is now firmly supported by the face panel and funnel. Thus, the aperture pattern in the tensed mask of the finished CRT differs from the distorted aperture pattern in the mask when it was used to form the CRT phosphor screen. Because of this fact, color impurity is apt to occur.

In U.S. Pat. No. 3,166,211 to Stel et al, there is disclosed means for strengthening CRT funnel in which an implosion-resistant non-compressive coating extends over a portion of the funnel. The implosion-resistant coating is said to comprise a layer of strongly adherent synthetic resin containing wire-like fibers.

Logue in U.S. Pat. No. 3,720,345 discloses a television bulb with improved strength. The funnel side walls which extend generally parallel to the horizontal axis of the faceplate have a central portion thereof which is substantially flat in all cross sections, and is smoothly interconnected with the remaining portions of the side walls. The funnel side walls which extend generally parallel to the vertical axis of the faceplate have portions thereof which are substantially bowed outwardly relative to the vertical axis, and side walls which extend generally parallel to the vertical axis of the faceplate have portions thereof which are substantially bowed outwardly relative to the vertical axis, and side walls which extend generally parallel to the horizontal axis of the faceplate. The design is said to provide a television picture tube having substantially lower tensile stresses in the yoke area when the bulb is later evacuated.

U.S. Pat. No. 3,894,321 to Moore, of common ownership herewith, is directed to a method for processing a color cathode ray tube having a thin foil mask sealed directly to the bulb. Included in this disclosure is a description of the sealing of a foil mask between the juncture of the skirt of the faceplate and the funnel. The foil mask is noted as having a greater thermal coefficient of expansion than the glass to which it is mounted, hence following a heating and cooling cycle in which the mask is cemented at the funnel-faceplate juncture, the greater shrinkage of the mask upon cooling places it under tension. The mask is shown as having two or more alignment holes near the corners of the mask which mate with alignment nipples in the faceplate. The nipples pass through the alignment holes to fit into recesses in the funnel. In another embodiment, the front panel is shown as having an inner ledge forming a continuous path around the tube, the top surface of which is a Q-distance away from the faceplate for receiving the foil mask such that the mask is sealed within the tube envelope. An embodiment is also shown in which the faceplate is skirtless and essentially flat.

The following patents are also noted: 1,163,495 (GB); 2,761,990; 3,440,469; 3,638,063; 3,873,874; 3,894,321; 4,069,567; and 4,495,437.

In accordance with the present invention, the support frame comprises a major portion of the funnel of the CRT itself. Thus not only are the advantages of the above-mentioned copending applications achieved, but the funnel structure of the CRT may be significantly reduced in weight with an overall reduction of processing times and weight of the finished CRT.

OBJECTS OF THE INVENTION

The principal object of the invention is to provide a tensed mask color CRT with improved color purity, reduced processing time and decreased weight.

BRIEF DESCRIPTION OF THE DRAWINGS

Further objects and advantages of the invention will be apparent upon reading the following description in conjunction with the drawings in which.

DESCRIPTION OF THE PREFERRED EMBODIMENT

Figure 1:
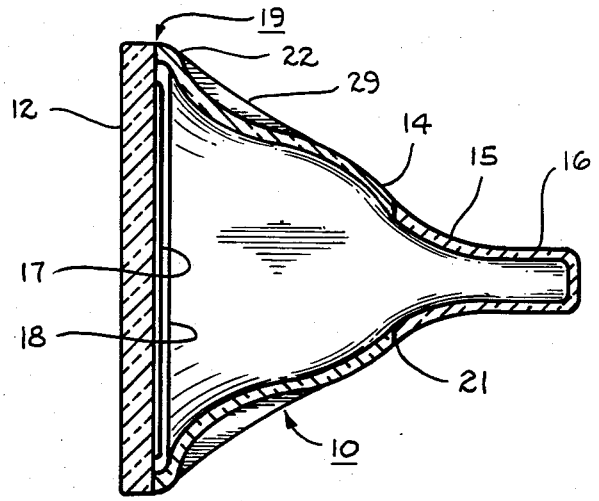
FIG. 1 represents a simplified cross section of a CRT constructed in accordance with the invention.

Referring to FIG. 1, a CRT 10 includes a flat or cylindrical glass panel or faceplate 12, (here shown as flat) a glass support frame 14 constructed in accordance with the invention, and a small, generally bell-shaped funnel 15 that extends into a small-diameter cylindrical neck 16 for housing an electron gun structure (not shown) of conventional form. Funnel 15 and frame 14 are part of what is generally referred to as the envelope of the CRT 10. The inner surface of panel 12 has formed thereon by conventional photodeposition techniques, a target or screen 17 consisting of a pattern of red-, blue-, and green-light-emitting phosphors corresponding to the pattern of apertures in a confronting shadow mask 18 that is maintained under tension. The support frame 14 includes a recessed shelf for supporting tensed shadow mask 18 a predetermined distance from screen 17, which distance is generally referred to as the "Q" distance. The elements of the CRT are joined together by devitrifiable frit at junctions 19 and 21. The glass frit devitrifies at high temperature to form a glass bond between the adjoining elements during manufacture of the CRT. AS will be explained, the bond at junction 21 may in the design of this support frame be formed by a flame-sealing operation; that is, a glass-to-glass melting between the lower portions of support frame 14 and the large end of funnel 15.

The support frame 14 has a deeply elongated skirt means 30 extending rearwardly from the faceplate. The deep configuration of this skirt, together with the flange 22, lends stiffness to the support frame 14 to enable the frame to resist distortion by the tension in the tensed mask. As will be shown, the skirt forms a major portion of the CRT envelope.

Figure 2:
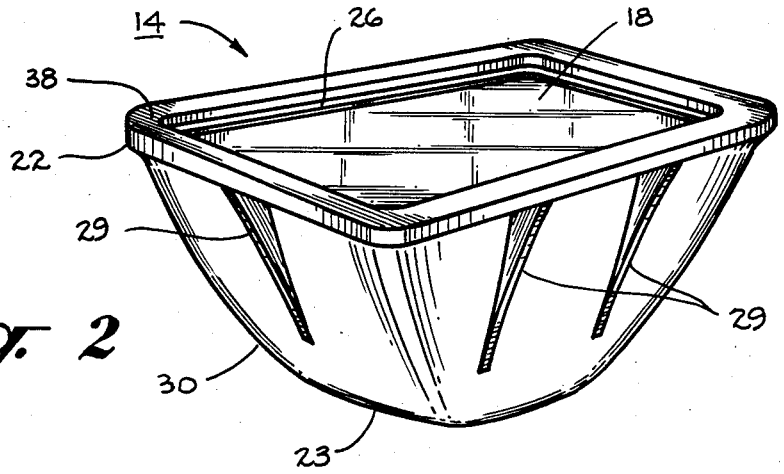
FIG. 2 is a perspective view of a mask support frame constructed in accordance with the invention.

Referring to FIG. 2, a perspective view of the support frame 14 is shown, constructed in accordance with the invention. A flat seal surface 38 forms the mating edge of the support frame 14, which may include registration means (not shown in this figure). Displaced from seal surface 38 is a shelf 26 upon which mask 18 is supported in tension by means of a bead of glass frit 28 which surrounds the periphery of mask 18. In accordance with an aspect of this invention, the very deep skirt 30 extends axially rearwardly from flange 22 and the shelf 26, terminating in another seal surface 23 at the small end of support frame 14. In accordance with another aspect of this invention, a plurality of axial strengthening ribs 29 are disposed about the periphery of support frame 14 for strengthening the support frame 14 in resistance to pressure vessel loads imposed during tube evacuation. The provision of the ribs enables the support frame to be constructed of much thinner glass than would otherwise be feasible. As clearly shown in FIG. 4, strengthening ribs 29 bridge the junction of flange 22 and skirt 30 of frame 14 and, as depicted in FIG. 2, are geometrically located in the vicinity of the major and minor axes of flange 22. Ribs 29 will be seen to add support to an outer flange 22 of the support frame in the area of shelf 26, thus enabling the structural juncture of the flange 22 and skirt 30 to withstand the discontinuity stresses imposed on panel 12 during evacuation. Flange 22 will be seen as radially outwardly and axially forwardly extending from skirt 30 for joining to the periphery of panel 12. Shelf 26 extends radially inwardly from flange 22 and provides a support surface for the edges of the tensed mask 18. Shelf 26 is shown also as being axially offset for determining a precise spaced relationship therebetween.

Figure 3A:
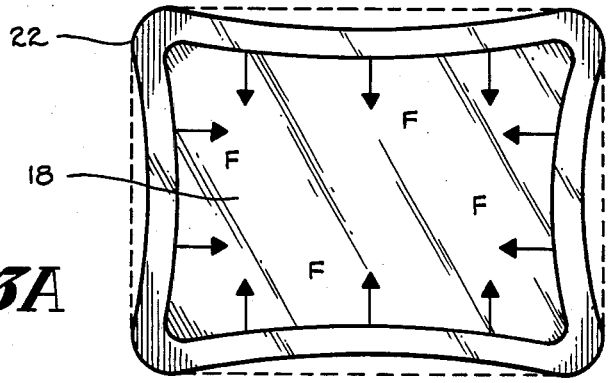
FIG. 3A is a plan view of a prior art support frame and tensed mask assembly with an exaggerated showing of the in plane distortion experienced therein.
Figure 3B:
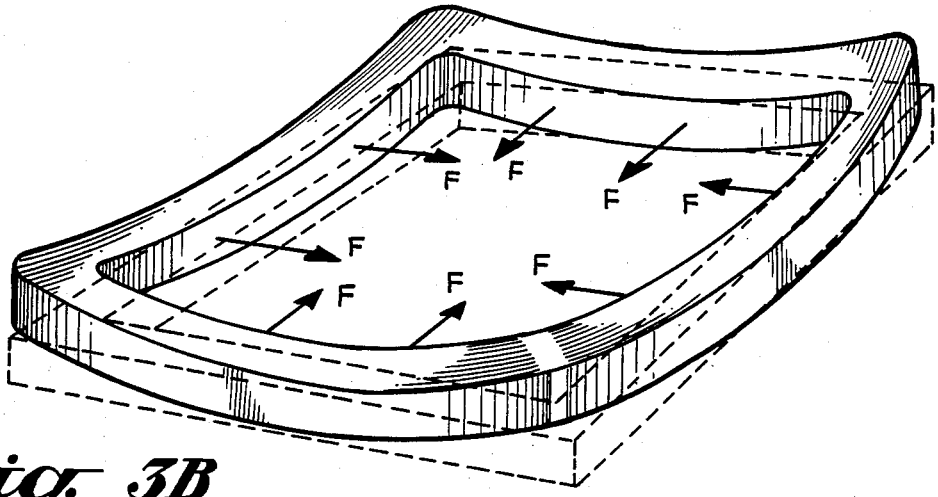
FIG. 3B is a perspective view of a prior art support frame and tensed mask assembly with an exaggerated showing of the transverse distortion experienced therein.

In FIG. 3A, a plan view, and in FIG. 3B, a perspective view, of a shallow glass support frame not having the features of the present invention, is shown to illustrate the deformation which results from the tensed mask forces exerted thereon absent a construction corresponding to frame 14. The forces are generally illustrated by the arrows labelled F. The dotted lines indicate the normal unstrained outline of the support frame. The inward distortion that occurs under the forces exerted by the tensed mask (exaggerated for illustrative purposes) is shown by the solid lines, in FIG. 3A, and the "pillowing" roll, and twist distortion caused by the same forces is shown by the solid lines in FIG. 3B. These distortions are "transferred" to the screen during screen formation, or to the black surround, or grille, during its formation, because of the similarly distorted tensed mask aperture pattern. However, as explained, in the finished CRT, the distortion induced by the tensed mask is relieved and color impurity therefore results.

Figure 4:
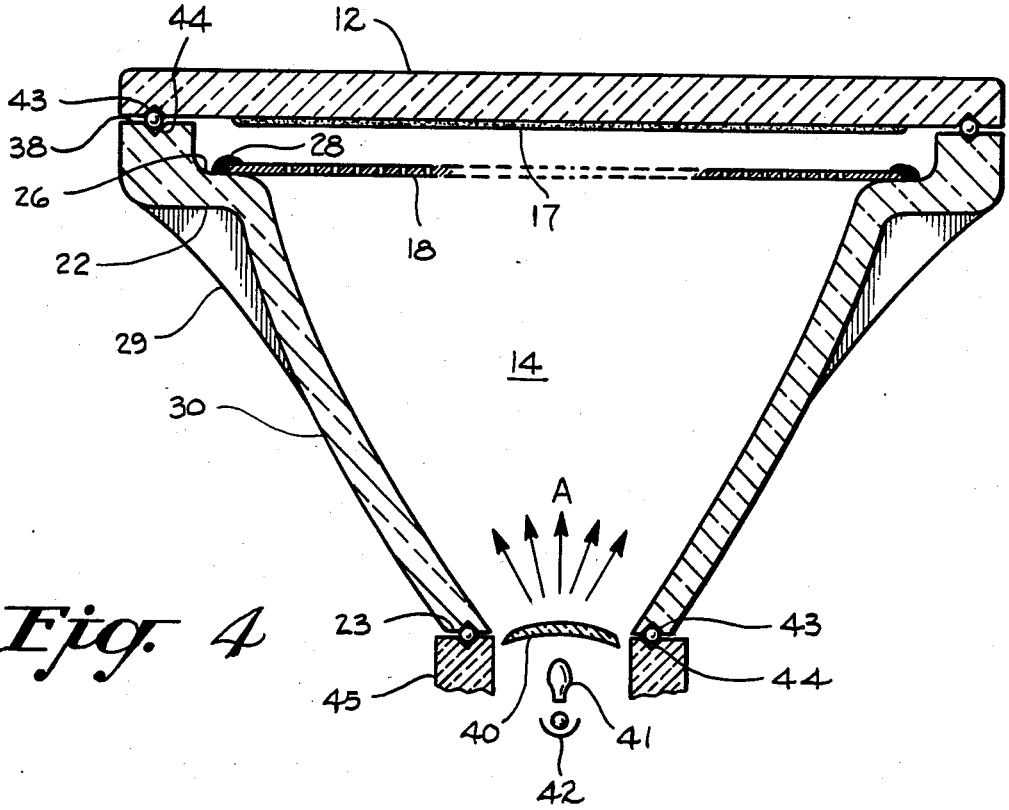
FIG. 4 is a partial cross section of an assembled support frame and panel, constructed in accordance with the invention, positioned at an exposure station.

In FIG. 4, an enlarged cross section of the support frame with a tensed mask assembled in position for screening in an exposure station corresponding to a conventional lighthouse is schematically illustrated. Flange 22 extends into shelf 26 forming a support surface parallel to flat panel 12 for supporting tensed mask 18 by means of frit bond 28. Support frame 14 has a deeply elongated skirt 30 extending rearwardly away from the shelf 26, forming the major portion of the CRT envelope. Skirt 30 terminates in a seal surface 23. One of a plurality of spaced strengthening ribs 29 is shown extending axially from outer flange 22 to a point towards the termination of the elongated skirt 30. As described above, the CRT envelope is a vessel that is subject to significant pressure due to atmospheric forces. Since the support frame 14 forms a major portion of the CRT envelope, it may ideally be of relatively light-weight construction, provided suitable strengthening members are incorporated. As illustrated, ball-and-groove registration means 43 and 44 are shown as being located at the intersections of the inner surface of panel 12 and seal surface 38 of support 14, and the seal surface 23 at the small end of support frame 14 and the corresponding walls 45 on the exposure station, respectively.

The exposure station includes a lens 40 disposed in the open end of support frame 14, a collimator tip 41, and a source of energy 42 actinic to the photosensitive screening coatings for directing rays of light to screen 17 through tensed aperture mask 18 for exposure of the photosensitive material on screen 17. As is well understood in the art, collimator tip 41 and lens 40 cooperate to simulate electron beams emanating from the appropriate position in the neck of the CRT corresponding to one of the electron beam sources. During conventional exposure of a black surround or grille, or the exposure of the individual colored-light-emitting phosphors, support frame 14 and panel 12 are positioned in registration on different lighthouses having collimator tips, lenses and sources arranged to simulate the individual locations of each of the electron guns in the CRT. Thus, to form a three color screen, three separate exposure steps would be performed with the lens and collimator tip being arranged to simulate the position of the red, blue and green electron guns, respectively, in the neck of the CRT. Also, in the case of a conventionally black-surround or grille-type color television picture tube, the exposures would be made with similar lighthouse arrangements to form black areas between those areas that are to receive the color phosphor deposits. These techniques are all well known in the art. Suffice it to say that registration means 43 and 44 are required for alignment of the panel and support frame during the screening processing. It will be appreciated that these same registration means will be used for final assembly of the CRT, with the small funnel being attached at seal end 23 and the electron gun being inserted in the open neck thereof. The CRT is frit-bonded and evacuated while being subjected to baking temperatures to complete its fabrication in accordance with conventional techniques. The substantial distance of screen 17 from seal surface 23 permits skirt 30 be flame-sealed to the funnel portion of the CRT if that is desired.

With the support frame construction of the invention, not only does an extremely rigid, substantially non-deformable support frame for the tensed mask result, but the thickness of the skirt may be reduced significantly from that of a conventional CRT envelope of similar size and type. Thus, there are the added advantages of savings in glass, reduced processing time, and reduced weight of the finished CRT. With this construction of a support frame, the prior-art problem of the screen being formed by exposure through the tensed mask in a distorted condition, and being operated with the tensed mask in undistorted condition, is eliminated.

It will be recognized that numerous modifications and changes in the described embodiment of the invention will be apparent to those skilled in the art without departing from its true spirit and scope. The invention is to be limited only as defined in the claims.

What is claimed is:

1. An integral support frame for a flat or cylindrical panel cathode ray tube adapted to support a tensed mask within the tube in precise, spaced relationship to the inner surface of the panel of the cathode ray tube, said frame comprising:

a radially outwardly and axially forwardly extending flange means for joining to the periphery of said panel;

shelf means extending radially inwardly from said flange means and providing a support surface for the edges of said tensed mask; and skirt means forming an integral structure with said flange means and extending axially rearwardly from said shelf means, and including a seal surface for joining to a short bell-shaped funnel portion of said tube, said frame forming a major portion of the tube envelope, said skirt means lending stiffness to said support frame to enable said support frame to resist distortion by the tension in said tensed mask.

2. The support frame of claim 1 further including a plurality of integrally formed axial strengthening ribs bridging said flange means and said skirt means for enhancing the resistance of said support frame to discontinuity stresses imposed by tube evacuation.

3. A cathode ray tube comprising: p1 a flat panel;

a tensed mask;

an envelope comprising an axially short, bell-shaped funnel portion and a support frame structurally bonded between said flat panel and said funnel portion for supporting said tensed mask within the cathode ray tube in a precise spaced relationship to the inner surface of said flat panel, said support frame comprising;

a radially outwardly and axially forwardly extending outer flange defining a seal surface parallel to said flat panel for joining to the periphery of said flat panel, said flange further comprising a shelf extending radially inwardly and being axially offset from said seal surface for determining a precise spaced relationship therebetween and for providing a support surface for supporting said tensed mask thereon, and a deeply elongated skirt means extending rearwardly away from said shelf and forming a major portion of the envelope of the CRT, said skirt means lending stiffness to said support frame to enable said support frame to resist distortion by the tension in said tensed mask.

4. The cathode ray tube of claim 3 in which said support frame further includes integrally formed strengthening ribs extending axially from said outer flange to said elongated skirt and bridging the juncture of said flange and said skirt for enhancing the resistance of said support frame to discontinuity stresses imposed by tube evacuation.

* * * * *